United States Patent [19]

Acker

[11] Patent Number: 4,777,704

[45] Date of Patent: Oct. 18, 1988

[54] BUTTON WITH GROMMET

[76] Inventor: Charles W. Acker, 203 Ava Rd., Toronto, Canada, M6C 1W8

[21] Appl. No.: 939,941

[22] Filed: Dec. 9, 1986

[51] Int. Cl.[4] ..... A44B 1/38

[52] U.S. Cl. ..... 24/106; 24/108; 24/574; 63/20

[58] Field of Search ..... 24/103, 106, 108, 110, 24/113 R, 141, 900, 656, 679, 680, 681, 697, 653, 573, 574; 63/1 A, 1 R, 20

[56] References Cited

U.S. PATENT DOCUMENTS

| | | | |
|---|---|---|---|
| 646,667 | 4/1900 | McDonald | 24/106 X |
| 1,368,878 | 2/1921 | Bandell | 24/108 |
| 1,690,129 | 11/1928 | Prentiss | 24/108 X |
| 2,683,908 | 7/1954 | Carpinella | 24/681 X |
| 2,748,517 | 6/1956 | Berkis | 41/34 |
| 2,928,151 | 3/1960 | Rozanski | 24/90 |
| 3,644,965 | 2/1972 | Kahn | 24/90 R |
| 3,689,962 | 9/1972 | Erikson | 24/108 |
| 3,691,597 | 9/1972 | Kahn | 24/108 |
| 3,967,348 | 7/1976 | Rogen | 24/90 E |
| 3,996,647 | 12/1976 | Bengtsson | 24/90 E |
| 4,344,240 | 8/1982 | Schiller | 40/20 R |
| 4,397,061 | 8/1983 | Kanzaka | 24/141 X |
| 4,481,696 | 11/1984 | Kanzaka | 24/113 R |
| 4,509,232 | 4/1985 | Kanzaka | 24/113 R |
| 4,512,063 | 4/1985 | Fukuroi | 24/94 |
| 4,516,294 | 5/1985 | Sanderson | 24/41 |

FOREIGN PATENT DOCUMENTS

| | | | |
|---|---|---|---|
| 867465 | 2/1953 | Fed. Rep. of Germany | 24/108 |
| 2919023 | 11/1980 | Fed. Rep. of Germany . | |
| 5447 | of 1909 | United Kingdom | 24/108 |

*Primary Examiner*—Kenneth J. Dorner
*Assistant Examiner*—Laurie K. Cranmer

[57] ABSTRACT

Snap fastener uses a grommet attached to a first layer of fabric and defining a passage. A unitary button and shank as designed to have the shank attach to the grommet with a snap action and on its free end to attach to a second layer of fabric.

4 Claims, 2 Drawing Sheets

Figure 3:
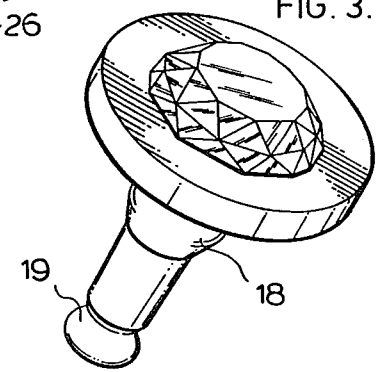

FIG. 1.
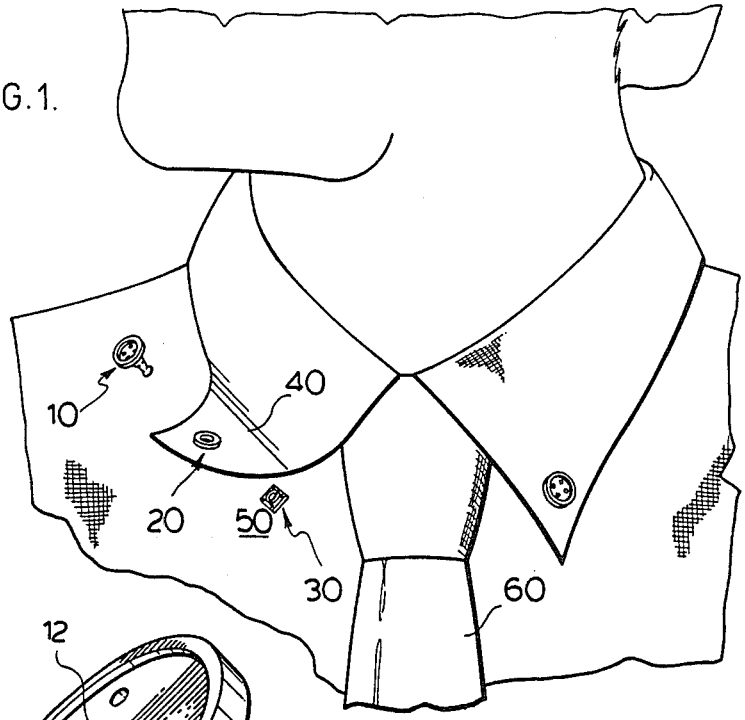
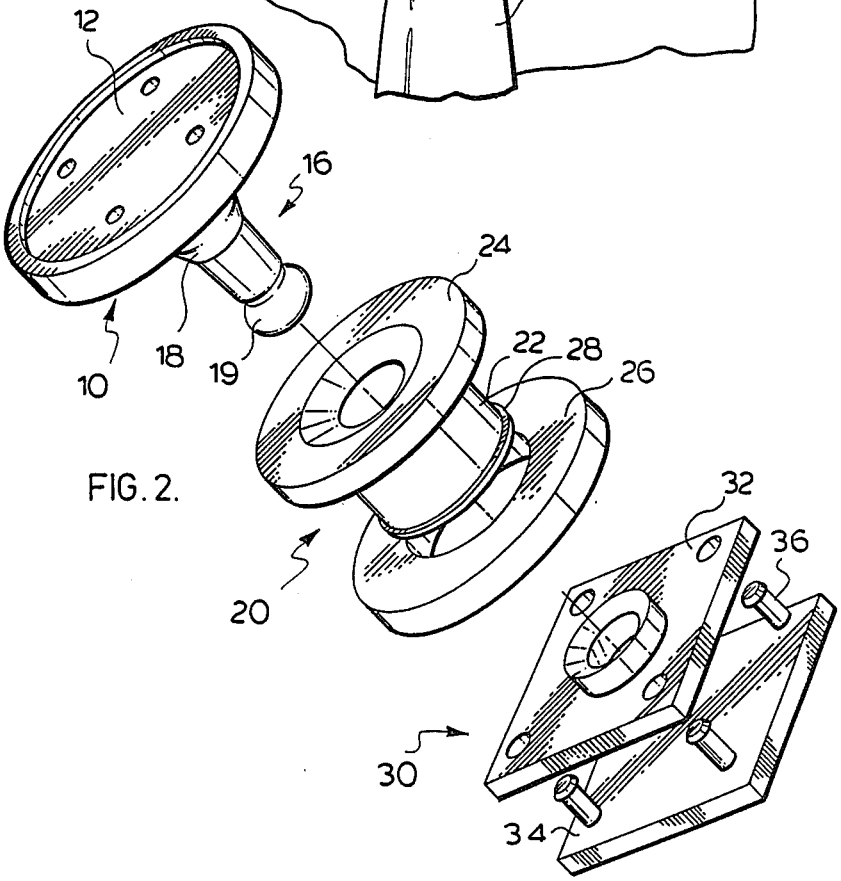
FIG. 2.

BUTTON WITH GROMMET

This invention relates to a novel method of attaching two clothing fabric layers together and provides a device which, while performing the above function, also serves as an attractive and suitable ornamentation to the clothing with which it is worn.

By 'point' herein I mean that portion of the collar adjacent the collar tip.

The invention is thought to have as its principal application a replacement for the button and buttonhole which will 'button-down' the point of a button-down dress shirt collar. The invention does, however, have other applications.

The general aspects of the invention are, as an example only, described in relation to the shirt collar point even though the invention has wider application. The invention provides a grommet for attachment to the collar point at the location where there would normally be a button hole. The grommet provides a passage through the collar point material. Anchoring means is provided on the shirt body beneath the point at the location where the button, corresponding to the buttonhole, would conventionally be sewn.

A button having the outside appearance of a conventional shirt button is provided with a shank extending from its inner side. The shank is designed to pass through the grommet and to leave a free end. The free end of the shank is designed to make releasable attachment with the anchoring means. The shank intermediate the button head and the free end is designed, in combination with the grommet to make a snap action attachment to and release from the grommet. Thus the button may be attached to the collar point by inserting the shank through the grommet to which it is attached by the snap action referred to. In its insertion the button head overlies and conceals the grommet.

The free end of the shank is then attached to the anchor means to provide a 'buttoned down' point for the shirt collar. The button is readily replaced by firstly, detachment with deliberate effort of the shank first from the anchor means and then from the grommet, and secondly choosing a replacement button with new shank inserted first through the grommets and then into the anchoring means. Thus the outer or exposed side of the button may be alternately of conventional appearance or ornamented in any desired manner and pairs of buttons of alternate appearance may be supplied for wearing on different occasions. Thus the exposed side of the button may have a conventional shirt button appearance or may be jewelled or otherwise ornamented, or have any other styled appearance.

The invention, when applied to a shirt collar, to create a 'buttoned-down' effect, produces an improved appearance over the conventional 'button-down' collar. This is because conventional 'button-down' collars require soft cloth so that the button-hole may slide over the button, and the soft cloth does not provide a firm collar profile. Since in this invention the collar is 'buttoned-down' by the shank releasably attached to the anchoring means, firmer cloth may be used for the collar, the point in particular, thus producing a desireably crisper collar profile.

An advantage over conventional 'button-down' shirts is that the buttons (and attached shanks) are detachable. Thus, buttons of, for example, conventional appearance can be replaced by, for example, two jewelled buttons having the same shank configuration, Thus the invention allows the points to be buttoned down and, at the same time, introduces a major new category of men's jewelry.

A further advantage over conventional button-down shirt points is that the buttons for the latter often become detached and lost and are resewn with difficulty. With this invention replacement buttons are not resewen but, with shank attached, are simply inserted into the grommet and held there, ready for snap-closure with the anchoring means.

As previously stated, although the use of grommet and anchoring means, with the button and shank is described above for connection of the collar point to the body of the shirt, the three elements described above may be used to connect two fabric layers in other positions and in other types of articles of dress with the same advantages of convenience and variability of appearance as those discussed above. For example another application would be to fasten the cuffs of a dress shirt with the same opportunity to replace the conventional cuff button with an ornamental button.

The button shank is attached to and released from the grommet by a snap action and the shank is preferably provided intermediate the button and the free end, with an enlargement which, on insertion of the stud into the grommet passage, provides the snap action for attachment of the shank to the grommet, which snap action is repeated on removal of the shank from this grommet passage.

The grommet is preferably assembled from two pieces. One piece is a one piece flange and sleeve, the flange resting on one side of the collar fabric and the sleeve passing therethrough. A second piece, a ring is placed on the other side of the fabric and is applied over the sleeve to attach thereto. The two piece grommet as described is provided on the inner surface of the sleeve with the means for the snap action effect with the button shank. As previously described this is usually embodied by an intermediate enlargement on the button shank cooperating with a restriction on the inside surface of the passage to provide the snap action.

The connection between the shank free end and the anchoring means may be conventional. Preferably the anchoring means comprises a small body with an outwardly opening socket designed to detachably receive an enlarged end of the shank with a snap action. Thus the preferred shank will have an enlargement to rest in the anchoring means and an intermediate enlargement to secure the shank to the grommet.

Figure 4:
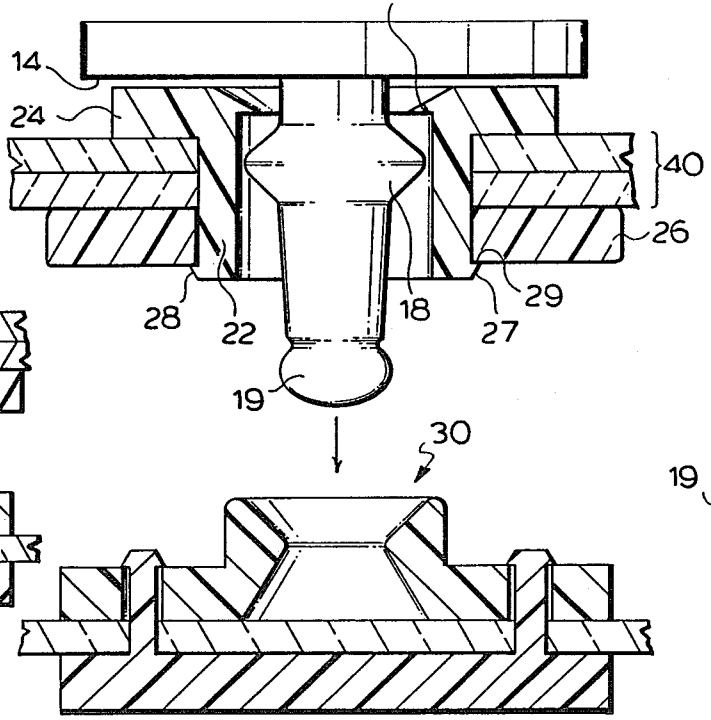
Figure 5:
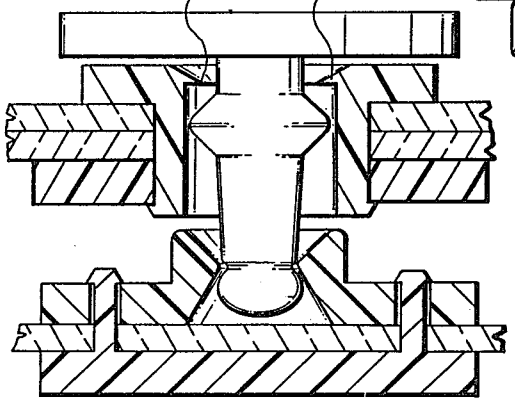

In drawings which illustrate a preferred embodiment of the invention:

FIG. 1 shows a collar point with components in accord with the invention,

FIG. 2 shows an exploded view of a button, shank, grommet and anchoring means in perspective, FIG. 3 shows a button and shank similar to that in FIG. 2 with a different exterior surface, FIG. 4 shows a section through a collar point and shirt body showing the components used in and with the invention before attachment of the shank to the anchoring means, and FIG. 5 shows the same elements as shown in FIG. 4 with the shank attached to the anchoring means.

In the drawings, FIG. 1 shows a button down dress shirt with fabric 50, a collar point 40. A grommet 20, in accord with the invention is located on the collar point 40 at the location conventionally occupied by a button hole. An anchoring means 30 is attached to the shirt body at the location normally occupied by the button for the button hole. A unitary button and shank 10 is provided with the shank designed to pass through the grommet 20 and attach thereto with a snap action while the end of the shank is designed for releasable attachment to the anchoring means 30, when the shank is extending through the grommet 20.

FIG. 2 shows a unitary button and shank. This may be molded from plastic or made of any other material. The button has an outer surface 12 which will be exposed in use and a lower surface 14 with shank 16 extending therefrom. Shank 16 is provided with an enlarged free end 19 for connection to anchoring means 30 and an intermediate enlargement 18 for snap attachment to and release of grommet 20.

Grommet 20 comprises hollow sleeve 22 having on one side a radially extending flange 24 designed to rest on one side of the fabric layer 40 composed here of a double layer of fabric (forming part of point 40) while the sleeve 22 goes through a hole in the fabric. A ring 26 fits over the free end of the sleeve 22 to rest on the other side of the fabric, and, together with the flange and sleeve, to form the assembled grommet. The ring may be attached to the sleeve in any desired manner. I prefer to make both grommet members from molded, somewhat resilient, plastic. I prefer to provide the annular enlagement 28 at the free end of the sleeve, bevelled at 27 to assist the ring to slide thereover, compressing the adjacent sleeve, which snaps back to retain the enlargement 28 with the inwardly facing shoulder 29. The ring 26 may be alternately or additionally held in place by adhesive or by thermal bonding or other conventional means. The ring 26 fixed on the sleeve 22 attaches the grommet to material 40 and defines a passage for the button shank 10 through the inner surface of the sleeve. Inwardly projecting annular ledge 25 forms a restriction in the inner surface of sleeve. The inwardly directed edge 23 of the ledge is designed to allow, with or without deflection, inward passage of the enlargement 19 and to be deflected to pass enlargement 18 with a snap action on insertion of the shank into or removal of the shank from the grommet passage. The grommet and shank or one of them is made of material sufficiently resilient to achieve such snap action. Any other cooperating means on grommet passage and shank to provide such snap action and releasable retention is within the scope of the invention.

FIG. 2 shows the preferred form of the anchoring means 30 for attachment to the shirt fabric at the location normally occupied by the 'button-down' button. The anchoring means (preferably of molded plastic) comprises an outer member 32 attached to an inner member by four probes 36 of inner member 34 passing outwardly through the shirt material. The outer member is arranged to define a socket 30 (see FIGS. 4 and 5) designed, (with the inherent resiliency of the member) to receive with snap action, the enlarged shank end 19, and to release it with a similar snap action. However it is noted that any suitable cooperating means between the shank and the anchoring means 30 for releasable retention may be used.

FIG. 3 shows a button and shank functionally equivalent to the same members in FIG. 2 except that the outer surface is jewelled instead of the button appearance of FIG. 2. The button head is dimensioned to overlie and conceal the grommet in use. One of the great advantages of the invention is that, in addition to the functional convenience, per se, the design allows simple alteration of appearance by replacement of the button of one appearance by a button of another appearance.

In operation, the dress shirt when purchased will normally have the grommet 20 and the anchoring means 30 permanently installed. The buttons with shanks are selected by the wearer. Each shank is then inserted through a grommet until both enlargements 19 and 18 have passed the restriction 25, the enlargement 18 passing with the snap action referred to. Thus each button is now fixed on the collar. After tying the tie 60, each shank free end enlargement 19 is snapped into the anchoring means socket and the shirt collar point is thus 'buttoned down'. If the wearer now wants to replace the conventional 'button' appearance of the FIG. 1 button he withdraws the shank first from the anchoring means, then outwardly through the grommet. A differently ornamented button and shank is selected such as the jewelled one of FIG. 3, and inserted as previously described.

I claim:

1. Snap fastener for connecting two layers of fabric comprising:

grommet for attachment to an outer layer of fabric to define a passage through said grommet from one side to the other of said outer layer, a restriction in said grommet passage, anchoring means attached to an inner layer for defining a socket, said anchoring means being located for alignment of said socket with said grommet passage, a button having a shank projecting therefrom, said shank being provided with a first enlargement at the end thereof remote from the button, dimensioned to pass through said grommet passage, said first enlargement and said anchoring means being shaped so that said first enlargement may make a releasable snap attachment with said anchoring means, said shank being provided with a second enlargement intermediate said button and said first enlargement, said second enlargement and said grommet and restriction being shaped so that said second enlargement may make a releasable snap attachment with said grommet restriction.

2. Snap fastener as claimed in claim 1 wherein said grommet comprises a unitary flange and sleeve assembled to a ring received over said sleeve when said flange is located on one side of said outer layer of fabric and said ring on the other side of said first layer.

3. Snap fastener for connecting two layers of fabric comprising:

grommet for attachment to an outer layer of fabric to define a passage through said grommet from one side to the other of said outer layer;

anchoring means attached to an inner layer for defining a socket, said anchoring means being located for alignment of said socket with said grommet passage;

a button having a shank projecting therefrom;

said shank being provided with a first enlargement at the end thereof remote from the button, dimensioned to pass through said grommet passage;

said first enlargement and said anchoring means being shaped so that said first enlargement may make a releasable snap attachment with said anchoring means;

said shank being provided with a second enlargement intermediate said button and said first enlargement;

a restriction in said grommet passage spaced from the end of said passage that is nearer the inner layer, said second enlargement and said grommet and restriction being shaped so that said second enlargement is contained within said grommet passage when said second enlargement is snap attached to said grommet restriction.

4. Snap fastener as claimed in claim 3 wherein said grommet comprises a unitary flange and sleeve assembled to a ring received over said sleeve when said flange is located on one side of said outer layer of fabric and said ring on the other side of said first layer.

* * * * *